US010077895B1

(12) United States Patent
Deng

(10) Patent No.: US 10,077,895 B1
(45) Date of Patent: Sep. 18, 2018

(54) MULTI-FUNCTION FLOODLIGHT

(71) Applicant: DONGGUAN PAN AMERICAN ELECTRONICS CO., LTD, DongGuan (CN)

(72) Inventor: Jinsheng Deng, DongGuan (CN)

(73) Assignee: DONGGUAN PAN AMERICAN ELECTRONICS CO., LTD, Dongguan (CN)

( * ) Notice: Subject to any disclaimer, the term of this patent is extended or adjusted under 35 U.S.C. 154(b) by 0 days.

(21) Appl. No.: 15/613,715

(22) Filed: Jun. 5, 2017

(30) Foreign Application Priority Data

Mar. 20, 2017 (CN) ..... 2017 2 0273590 U

(51) Int. Cl.

| | |
|---|---|
| ***F21V 29/00*** | (2015.01) |
| ***F21V 29/76*** | (2015.01) |
| ***F21S 9/02*** | (2006.01) |
| ***F21V 21/30*** | (2006.01) |
| ***F21V 31/00*** | (2006.01) |
| ***F21V 29/83*** | (2015.01) |
| *F21V 23/00* | (2015.01) |
| *F21V 3/00* | (2015.01) |

(52) U.S. Cl.
CPC ..... *F21V 29/767* (2015.01); *F21S 9/022* (2013.01); *F21V 21/30* (2013.01); *F21V 29/83* (2015.01); *F21V 31/005* (2013.01); *F21V 3/00* (2013.01); *F21V 23/003* (2013.01)

(58) Field of Classification Search
CPC ..... F21V 29/767; F21V 29/83; F21V 21/30; F21V 31/005; F21S 9/022
See application file for complete search history.

(56) References Cited

U.S. PATENT DOCUMENTS

| | | | | |
|---|---|---|---|---|
| 2011/0242828 | A1* | 10/2011 | Blincoe | F21V 29/004 362/373 |
| 2013/0242574 | A1* | 9/2013 | Guercio | F21V 23/008 362/373 |
| 2017/0045214 | A1* | 2/2017 | Johnson | F21V 3/061 |
| 2017/0370571 | A2* | 12/2017 | Guercio | F21V 29/76 |

* cited by examiner

*Primary Examiner* — Thomas M Sember
(74) *Attorney, Agent, or Firm* — Polsinelli PC

(57) ABSTRACT

A multi-function floodlight includes: a heat sink comprising a main body, and a plurality of heat dissipating fins mounted on the heat sink; a heat dissipating cover enclosing the heat sink; a bracket rotatably connected to the heat dissipating cover; an upper cap covering a top of the heat dissipating cover; a light transmitting lower cap covering a bottom of the heat dissipating cover, a waterproof gasket is provided between the light transmitting lower cap and the main body, the main body and the light transmitting lower cap cooperatively define a containing chamber; a light emitting assembly mounted on the heat sink, the light emitting assembly is received in the containing chamber; a driver mounted on the plurality of heat dissipating fins and electrically coupled to the light emitting assembly; and an emergency battery mounted on the plurality of heat dissipating fins.

10 Claims, 4 Drawing Sheets

MULTI-FUNCTION FLOODLIGHT

CROSS REFERENCE TO RELATED APPLICATION

This application claims priority to Chinese Patent Application No. 201720273590.4, entitled "MULTI-FUNCTION FLOODLIGHT" filed on Mar. 20, 2017, the contents of which are expressly incorporated by reference herein in its entirety.

FIELD OF THE INVENTION

The present disclosure relates to the field of illuminating technology, and more particularly relates to a multi-function floodlight.

BACKGROUND OF THE INVENTION

A conventional floodlight as a point light which can evenly illuminate in all directions and illuminate the entire scene, so as to achieve better illuminating effects. Therefore, it is being widely applied in billboards, highways, railway tunnels, bridges, squares, construction and other places, which bring a lot of convenience for people's production and life.

However, the conventional floodlight having lager power also exits some disadvantages, which has poor heat dissipating, cannot achieve evenly and rapidly heat dissipating, thereby resulting in high internal temperature in the floodlight and shortening the using life thereof.

SUMMARY

Therefore, it is necessary to provide a multi-function floodlight having a good heat dissipating effect.

A multi-function floodlight includes: a heat sink comprising a main body, and a plurality of heat dissipating fins mounted on the main body; a heat dissipating cover enclosing the heat sink; a bracket rotatably connected to the heat dissipating cover; an upper cap covering a top of the heat dissipating cover, the heat dissipating fin is arranged adjacent to the upper cap; a light transmitting lower cap covering a bottom of the heat dissipating cover, a waterproof gasket is provided between the light transmitting lower cap and the main body, the main body and the light transmitting lower cap cooperatively define a containing chamber; a light emitting assembly mounted on the heat sink, the light emitting assembly is received in the containing chamber; a driver mounted on the plurality of heat dissipating fins and electrically coupled to the light emitting assembly; and an emergency battery mounted on the plurality of heat dissipating fins.

These and other features of the present invention will become readily apparent upon further review of the following specification and drawings.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. The accompanying drawings in the following description are only some embodiments of the present invention, and persons of ordinary skill in the art can derive other obvious variations from the accompanying drawings without creative efforts.

DETAILED DESCRIPTION OF THE EMBODIMENTS

Figure 1:
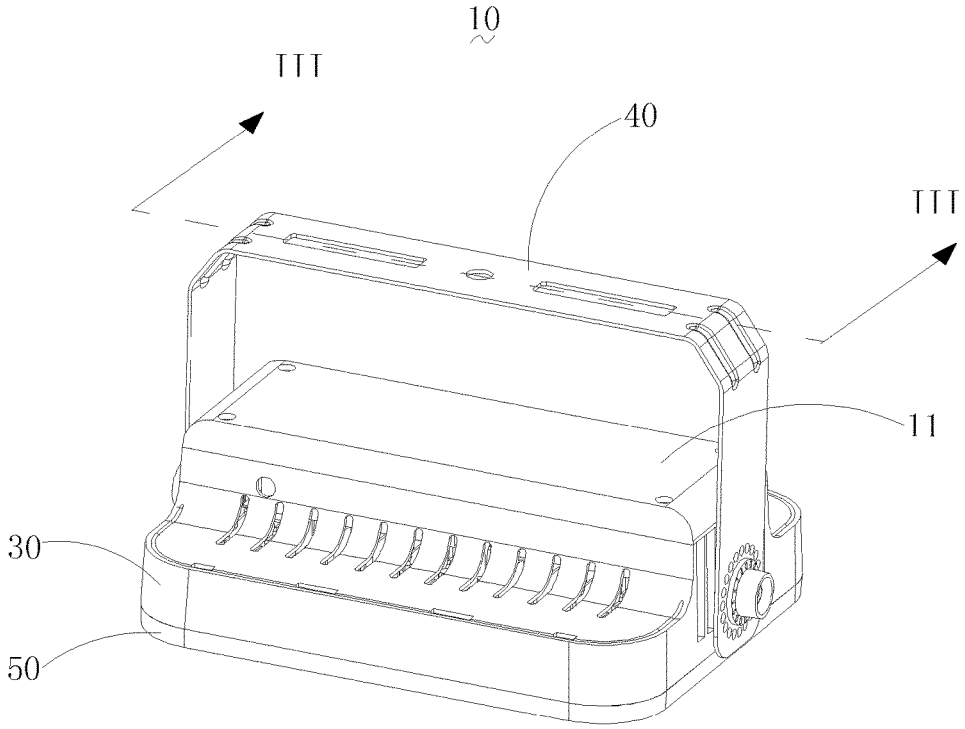
FIG. 1 is a perspective view of a multi-function floodlight according to an embodiment.

Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 2:
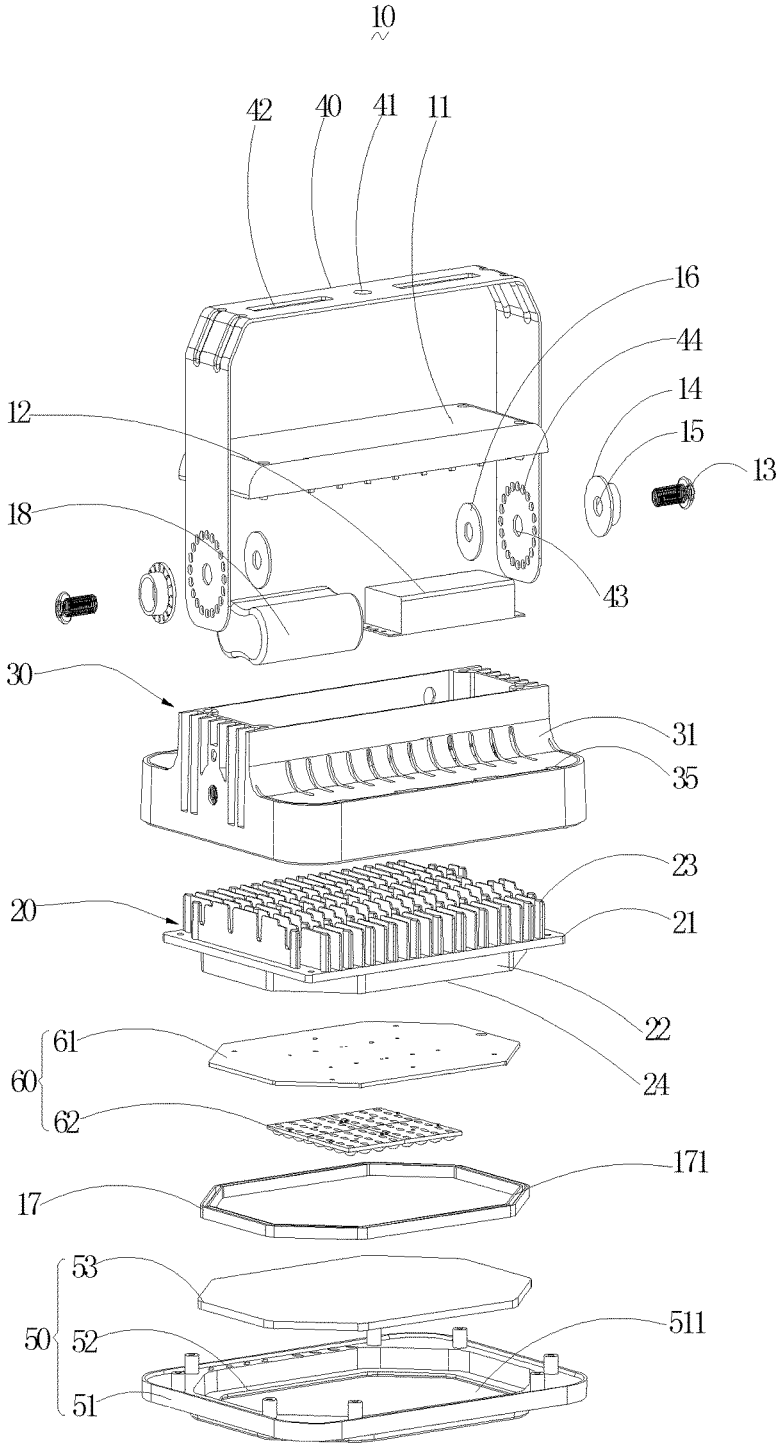
FIG. 2 is an exploded view of the multi-function floodlight of FIG. 1.

Referring to FIGS. 1 and 2, a multi-function floodlight 10 according to an embodiment includes a heat sink 20, a heat dissipating cover 30 enclosing the heat sink 20, a bracket 40 rotatably connected to the heat dissipating cover 30, an upper cap 11 covering a top of the heat dissipating cover 30, a light transmitting lower cap 50 covering a bottom of the heat dissipating cover 30, a driver 12 mounted on the plurality of heat dissipating fins 23 and electrically coupled to the light emitting assembly 60 via wires; and a light emitting assembly 60 mounted on the heat sink 20.

The heat sink 20 includes a main body 21 and a plurality of heat dissipating fins 23. the heat dissipating fin 23 is arranged proximately to the upper cap 11. The main body 21 and the heat sink 23 are capable of dissipating heat generated by the light emitting assembly 60. The plurality of heat dissipating fins 23 can increase the heat dissipating area, thus improving the heat dissipating effect.

Figure 3:
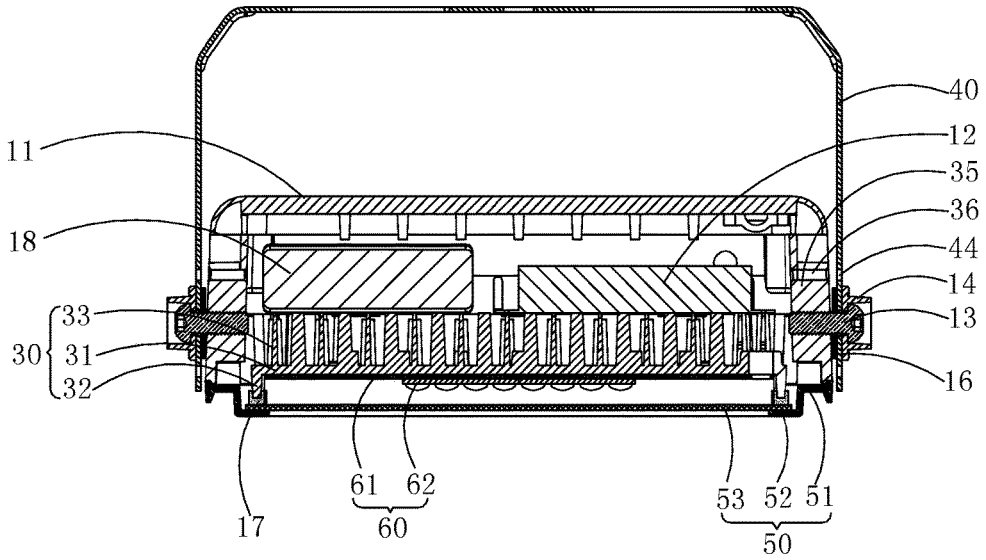
FIG. 3 is a cross-section view taken along line III-III of FIG. 1.

Referring to FIGS. 2 and 3, the main body 21 is provided with a annular protrusion 22 to form a containing chamber 24. The annular protrusion 22 is located on a side of the main body 21 proximately to light transmitting lower cap 50. A waterproof gasket 17 is provided between the heat sink 20 and the light transmitting lower cap 50 to prevent external water from entering the containing chamber 24 to affect working of the light emitting assembly 60. The waterproof gasket 17 defines a slot 171, the annular protrusion 22 is inserted into the slot 171 to fix the waterproof gasket 17.

Figure 4:
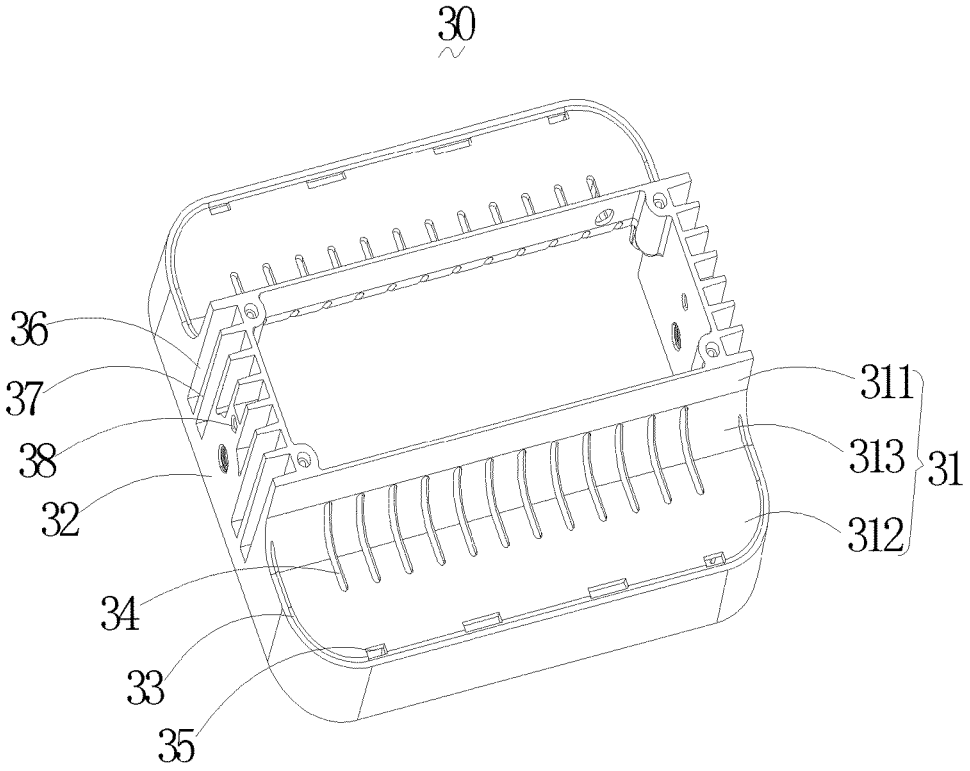
FIG. 4 is a perspective view of a heat dissipating cover of the multi-function floodlight of FIG. 2.

Referring to FIG. 4, the heat dissipating cover 30 has two opposed ventilation plates 31 and two fixing side plates 32 connected to the two ventilation plates 31, respectively. Each ventilation plate 31 has a first flat portion 311 proximately to the top of the heat dissipating cover 30, a second flat portion 312 proximately to the bottom of the heat dissipating cover 30, and a curved transition portion 313 connecting the first flat portion 311 to the second flat portion 312. The second flat portion 312 defines a first heat dissipating groove 33 on an edge thereof. On one aspect, the first heat dissipating groove 33 can increase an outer surface area of the heat dissipating cover 30 and accelerate the heat dissipating speed of the heat dissipating cover 30. On the other aspect, and the first heat dissipating groove 33 can increase the beauty of the heat dissipating cover 30.

Each fixing side plate 32 defines a second heat dissipating groove 36 used to increase the dissipating area of the heat dissipating cover 30, and a heat dissipating protrusion 37 is located in the second heat dissipating groove 36. The heat dissipating protrusion 37 is used to further increase the heat dissipating area of the heat dissipating cover 30. Each fixing side plate 32 is respectively defines a first wiring hole 38 corresponding to the driver 12. The first wiring hole 38 allows wires connecting the driver 12 to an external power source to extend through, thereby providing a power source for the driver 12.

The heat cover 30 respectively defines a first heat dissipating hole 34 and a second heat dissipating hole 35 on both sides thereof to form convective air so that the heat transferred from the light emitting assembly 60 to the heat sink 20 can be quickly brought to the outside of the heat dissipating cover 30, thereby reducing the heat generated from the light emitting assembly 60 when it works. The first dissipating hole 34 extends to the second flat portion 312 from the curved transition portion 313, and the second dissipating hole 35 is located on the second flat portion 312. The second dissipating hole 35 is shaped as a square, a roundness and so on. In the illustrated embodiment, the second dissipating hole 35 is shaped as the square and located adjacent to the first heat dissipating groove 33.

Referring to FIGS. 2 and 3 again, the bracket 40 is rotatably connected to the heat dissipating cover 30, such that the bracket 40 is rotatable relative to the heat dissipating cover 30, so as to change the angle of the bracket 40. Therefore, the multi-function floodlight 10 of the present embodiment is not only allowed to be mounted on the steel frame, the wall or the ceiling, but also the light emitting angle of the multi-function floodlight 10 can be changed according to the needs of the people.

The bracket 40 defines a round mounting hole 41 and two waist-shaped mounting holes 42, and the round mounting hole 41 is located on a central part of the bracket 40 and the two waist-shaped mounting holes 42 are located on both sides of the round mounting hole 41, respectively.

The bracket 40 is U-shaped, and both ends of the bracket 40 are rotatably connected to the two fixing side plates 32, respectively. Furthermore, an end of the bracket 40 defines a first through hole 43, the bracket 40 is connected to the heat dissipating cover 30 via a fastening screw 13 extending through the first through hole 43. When the angle of the bracket 40 relative to the heat dissipating cover 30 is to be changed, the fastening screw 13 is rotated to loosen the bracket 40. When the bracket 40 is rotated to a desired angle, and the fastening screw 13 is rotated until the bracket 40 is fixed on the fixing side plate 32, therefore the bracket 40 is less likely to rotate under the external force.

In order to prevent frictional damage between the end of the bracket 40 and the fixing side plate 32, a gasket 16 is provided between the end of the bracket 40 and the fixing side plate 32, and the gasket 16 is sleeved on the fastening screw 13.

The bracket 40 is provided with a knob 14 on the edge thereof. The knob 14 is located on a side of the bracket 40 away from the heat dissipating cover 30. The knob 14 defines a second through hole 15 corresponding to the fastening screw 13. The fastening screw 13 extends through the second through hole 15, the first through hole 43, and being fixed on the gasket 16. When the bracket 40 is to be rotated, the end of the bracket 40 can be easily rotated via the knob 14, thereby achieving the purpose of driving the entire bracket 40 to rotate.

The bracket 40 defines a plurality of second wiring holes 44 corresponding to the first wiring hole 38 on the edge thereof, and the plurality of second wiring hole 44 are uniformly distributed around the knob 14. The arrangement of the second wiring hole 44, on the one aspect, allows the outside air to pass through between the bracket 40 and the fixing side plate 32, which facilitates the discharge of heat from the fixing side plate 32. On the other aspect, when the bracket 40 is rotated by a certain angle, the first wiring hole 38 always communicates with a certain second wiring hole 44, so that the length of wires connecting the driver 12 to the external power source and extending through the fixing side plate 32 and the bracket 40 becomes short.

The light transmitting lower cap 50 includes a glass frame 51 connected to the heat dissipating cover 30 and a tempered glass 53 mounted in the glass frame 51. The glass frame 51 has a light transmitting hole 511 in a middle portion. The glass frame 51 is provided with a block portion 52 extending inward from an edge of the light transmitting hole 511. The tempered glass 53 can be sandwiched between the waterproof gasket 17 and the block portion 52.

The light emitting assembly 60 is received in the containing chamber 24 defined by the main body 21 and the light transmitting lower cap 50. The light emitting assembly 60 includes an aluminum substrate 61 fixed on the main body 21 and a lens 62 mounted on the aluminum substrate 61. A side plate of the aluminum substrate 61 away from the main body 21 is provided with a plurality of LED beads (not shown). The lens 62 cover the plurality of LED beads.

The multi-function floodlight 10 further includes an emergency battery 18. The emergency battery 18 is arranged in the heat dissipating cover 30 and mounted on the plurality of heat dissipating fins 23, and is electronically coupled to the aluminum substrate 61 of the light emitting assembly 60 via wires. The arrangement of the emergency battery 18 enables the multi-function floodlight 10 to have an function of emergency illuminating. Thanks to the emergency battery 18, when the power is turned off, it is possible to disengage the multi-function floodlight 10 from the wall for emergency use as a flashlight.

According to the foregoing multi-function floodlight 10, the heat sink 20 having the main body 21 and the plurality of heat dissipating fins 23 can increase the heat dissipating area, thus improving the heat dissipating effect. By arranging the driver 12 and the light emitting assembly 60 on both sides of the heat sink 20, respectively, the heat generated by the light emitting assembly 60 is prevented from affecting the driver 12.

The foregoing implementations are merely specific embodiments of the present disclosure, but are not intended to limit the protection scope of the present disclosure. It should be noted that persons skilled in the art can understand and embody all or part of flowcharts of the above implementations. Equivalent variation figured out by persons skilled in the art shall all fall within the protection scope of the present disclosure.

What is claimed is:

1. A multi-function floodlight comprising:

a heat sink comprising a main body and a plurality of heat dissipating fins mounted on the main body;

a heat dissipating cover enclosing the heat sink;

a bracket rotatably connected to the heat dissipating cover;

an upper cap covering a top of the heat dissipating cover, wherein the heat dissipating fins are arranged adjacent to the upper cap;

a light transmitting lower cap covering a bottom of the heat dissipating cover, wherein a waterproof gasket is provided between the light transmitting lower cap and the main body, the main body and the light transmitting lower cap cooperatively define a containing chamber;

a light emitting assembly received in the containing chamber and mounted on the main body;

a driver mounted on the plurality of heat dissipating fins and electrically coupled to the light emitting assembly; and an emergency battery mounted on the plurality of heat dissipating fins.

2. The multi-function floodlight of claim 1, wherein the heat dissipating cover has two opposed ventilation plates and two fixing side plates connected to the two ventilation plates, respectively; each fixing side plate is rotatably connected to the bracket, and each fixing side plate defines a first wiring hole corresponding to the driver.

3. The multi-function floodlight of claim 2, wherein each ventilation plate has a first flat portion proximately to the top of the heat dissipating cover, a second flat portion proximately to the bottom of the heat dissipating cover, and a curved transition portion connecting the first flat portion to the second flat portion; wherein the second flat portion defines a first heat dissipating groove on an edge thereof.

4. The multi-function floodlight of claim 3, wherein the heat dissipating cover defines a first heat dissipating hole and a second dissipating hole on both side thereof, respectively; the first dissipating hole extends to the second flat portion from the curved transition portion, and the second dissipating hole is located on the second flat portion.

5. The multi-function floodlight of claim 2, wherein each fixing side plate defines a second heat dissipating groove, and a heat dissipating protrusion is located in the second heat dissipating groove.

6. The multi-function floodlight of claim 2, wherein the bracket is U-shaped, and both ends of the bracket are rotatably connected to the two fixing side plates, respectively.

7. The multi-function floodlight of claim 6, wherein the bracket defines a first through hole on an end thereof, the bracket is connected to the heat dissipating cover via a fastening screw extending through the first through hole.

8. The multi-function floodlight of claim 7, wherein the bracket is provided with a knob on the end thereof, the knob is located on a side of the bracket away from the heat dissipating cover, the knob defines a second through hole, and the fastening screw extends through the second through hole.

9. The multi-function floodlight of claim 8, wherein the bracket defines a plurality of second wiring holes on the edge thereof corresponding to the first wiring hole, and the plurality of second wiring holes are uniformly distributed around the knob.

10. The multi-function floodlight of claim 1, wherein the light transmitting lower cap comprises a glass frame connected to the heat dissipating cover and a tempered glass mounted in the glass frame; the glass frame has a light transmitting hole, the glass frame is provided with a block portion extending inward from an edge of the light transmitting hole, the tempered glass is sandwiched between the waterproof gasket and the block portion.

* * * * *